US012753459B2

(12) United States Patent
Tanaka et al.

(10) Patent No.: US 12,753,459 B2
(45) Date of Patent: Oct. 6, 2026

(54) STEEL SHEET

(71) Applicant: NIPPON STEEL CORPORATION, Tokyo (JP)

(72) Inventors: Yasuaki Tanaka, Tokyo (JP); Shohei Yabu, Tokyo (JP); Hiroshi Shuto, Tokyo (JP); Koutarou Hayashi, Tokyo (JP); Takashi Yasutomi, Tokyo (JP); Eisaku Sakurada, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 475 days.

(21) Appl. No.: 18/280,105

(22) PCT Filed: Feb. 22, 2022

(86) PCT No.: PCT/JP2022/007131
§ 371 (c)(1),
(2) Date: Sep. 1, 2023

(87) PCT Pub. No.: WO2022/185991
PCT Pub. Date: Sep. 9, 2022

(65) Prior Publication Data

US 2024/0068066 A1 Feb. 29, 2024

(30) Foreign Application Priority Data

Mar. 2, 2021 (JP) ..... 2021-032761

(51) Int. Cl.

| | |
|---|---|
| ***C22C 38/00*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/60*** | (2006.01) |

(52) U.S. Cl.
CPC ..... *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C22C 38/60* (2013.01)

(58) Field of Classification Search
CPC ..... C21D 9/46; C21D 6/005; C21D 6/008; C21D 8/0247; C21D 2211/002; C21D 2211/005; C21D 1/02; C21D 8/0205; C21D 8/0226; C21D 8/0263; C21D 2201/05; C21D 2211/008; C21D 8/0221; C22C 38/001; C22C 38/002; C22C 38/02; C22C 38/04; C22C 38/06; C22C 38/14; C22C 38/60; C22C 38/008; C22C 38/005; C22C 38/08; C22C 38/12; C22C 38/16; C22C 38/22; C22C 38/28; C22C 38/38; C22C 38/58
See application file for complete search history.

(56) References Cited

U.S. PATENT DOCUMENTS

| | | | | |
|---|---|---|---|---|
| 8,353,992 | B2 * | 1/2013 | Sugiura | C21D 6/008 148/333 |
| 12,060,631 | B2 * | 8/2024 | Abukawa | C22C 38/02 |
| 12,264,374 | B2 * | 4/2025 | Ito | C22C 38/12 |
| 2013/0153091 | A1 * | 6/2013 | Fujita | C22C 38/50 420/104 |
| 2014/0030546 | A1 | 1/2014 | Suwa et al. | |
| 2014/0124101 | A1 | 5/2014 | Suwa et al. | |
| 2021/0404040 | A1 | 12/2021 | Abukawa et al. | |
| 2022/0042147 | A1 | 2/2022 | Shuto et al. | |
| 2022/0090228 | A1 | 3/2022 | Abukawa et al. | |
| 2022/0389545 | A1 | 12/2022 | Yabu et al. | |

FOREIGN PATENT DOCUMENTS

| | | | |
|---|---|---|---|
| JP | 2001-303175 | A | 10/2001 |
| JP | 2013-104114 | A | 5/2013 |
| KR | 10-2013-0126739 | A | 11/2013 |
| WO | WO 2012/141265 | A1 | 10/2012 |
| WO | WO 2020/110843 | A1 | 6/2020 |
| WO | WO 2020/110855 | A1 | 6/2020 |
| WO | WO 2020/184356 | A1 | 9/2020 |
| WO | WO 2020/184372 | A1 | 9/2020 |

* cited by examiner

*Primary Examiner* — John A Hevey
(74) *Attorney, Agent, or Firm* — Birch, Stewart, Kolasch & Birch, LLP

(57) ABSTRACT

There is provided a steel sheet having a chemical composition comprising, in mass %, C: 0.05 to 0.25%, Si: 0.2 to 2.0%, Mn: 1.2 to 3.0%, P: 0.030% or less, S: 0.050% or less, Al: 0.01 to 0.55%, N: 0.0100% or less, and Ti: 0.010 to 0.250%, with the balance: Fe and impurities, wherein a random intensity ratio of a texture in a near-surface portion of the steel sheet is 8.0 or less, and a minimum angle formed between a maximum strength orientation in a {110} pole figure of the texture and a normal direction of a rolled surface of the steel sheet is 10° or less.

6 Claims, No Drawings

STEEL SHEET

TECHNICAL FIELD

The present invention relates to a steel sheet.

BACKGROUND ART

With increasing needs of weight reduction against a backdrop of an energy issue, high-strength steel sheets, which can be thinner in their sheet thicknesses, are being applied to a wide range of members of private automobiles and trucks. Many of these automobile body components are formed by pressing. A high-strength steel sheet to be applied to undercarriage components, which have complex shapes in particular, is required to have an excellent bending workability.

For example, Patent Document 1 discloses a ferritic thin steel sheet in which an average value of X-ray random intensity ratios of an orientation group including {100}<011> to {223}<110> of a sheet surface at a ½ sheet thickness is 3.0 or more, an average value of X-ray random intensity ratios in three crystal orientations including {554}<225>, {111}<112>, and {111}<110> is 3.5 or less, and additionally, at least one of an r value in a rolling direction and an r value in a direction perpendicular to the rolling direction is 0.7 or less. Patent Document 2 discloses a cold-rolled steel sheet in which an X-ray random intensity ratio of (111)//ND is 3 or more, and an X-ray random intensity ratio of (100)//ND is 1 or less.

LIST OF PRIOR ART DOCUMENTS

Patent Document

Patent Document 1: JP2001-303175A
Patent Document 2: JP2013-104114A

SUMMARY OF INVENTION

Technical Problem

The present inventors conducted various bending tests on hot-rolled steel sheets each having a tensile strength of 780 MPa or more. As a result, it has been found that there is a case where, although cracking did not occur when a bending ridge was parallel to a rolling direction, cracking occurred when a bending ridge was orthogonal to the rolling direction, that is, parallel to a sheet width direction, and it has been found that the steel sheets have bending anisotropy.

An objective of the present invention is to solve the problems described above and to provide a steel sheet that has a high tensile strength, a low bending anisotropy, and an excellent bendability.

Solution to Problem

The present invention is made to solve the above problems and has a gist of the following steel sheet.

(1) A steel sheet having a chemical composition including, in mass %:

C: 0.05 to 0.25%,
Si: 0.2 to 2.0%,
Mn: 1.2 to 3.0%,
P: 0.030% or less,
S: 0.050% or less, Al: 0.01 to 0.55%,
N: 0.0100% or less, and
Ti: 0.010 to 0.250%,
with the balance: Fe and impurities, wherein a random intensity ratio of a texture in a near-surface portion of the steel sheet is 8.0 or less, and a minimum angle formed between a maximum strength orientation in a {110} pole figure of the texture and a normal direction of a rolled surface of the steel sheet is 100 or less.

(2) The steel sheet according to (1) above, wherein the chemical composition contains, in lieu of a part of the Fe, one or more elements selected from, in mass %:

Cr: 0.50% or less,
Ni: 0.50% or less, and
Cu: 0.50% or less.

(3) The steel sheet according to (1) or (2) above, wherein the chemical composition contains, in lieu of a part of the Fe, one or more elements selected from, in mass %:

Nb: 0.040% or less,
V: 0.15% or less,
Zr: 0.15% or less,
Mo: 0.15% or less, and
W: 0.15% or less.

(4) The steel sheet according to any one of (1) to (3) above, wherein the chemical composition contains, in lieu of a part of the Fe, one or more elements selected from, in mass %, Sn, Sb, and Te at 0.100% or less in total.

(5) The steel sheet according to any one of (1) to (4) above, wherein the chemical composition contains, in lieu of a part of the Fe, one or more elements selected from, in mass %, Ca, Mg, and REM at 0.0050% or less in total.

(6) The steel sheet according to any one of (1) to (5) above, wherein the chemical composition contains, in lieu of a part of the Fe, in mass %, B: 0.0050% or less.

Advantageous Effects of Invention

According to the present invention, it is possible to provide a steel sheet that has a tensile strength of 780 MPa or more, has a low bending anisotropy, and has an excellent bendability.

DESCRIPTION OF EMBODIMENTS

The present inventors conducted studies and experiments about a method for reducing a bending anisotropy of a high-strength steel sheet having a tensile strength of 780 MPa or more and consequently found the following findings.

When a bending test is conducted, cracking occurs on a bending ridge on an outer side. The present inventors conducted investigations about a mechanism of the occurrence of cracking and consequently found that formation of a shear band in a near-surface portion of a steel sheet serves as a precursor phenomenon.

The present inventors therefore conducted further studies about a method for suppressing the formation of a shear band in a near-surface portion of a steel sheet and consequently found that controlling a texture in the near-surface portion of the steel sheet is highly effective. That is, although attention has conventionally been paid only to a texture in an inner portion of a steel sheet, the present inventors found that the texture in the near-surface portion of the steel sheet has a great influence on the occurrence of cracking in a bending test.

The present invention is made based on the findings described above. Requirements of the present invention will be described below in detail.

(A) Chemical Composition

Reasons for limiting a content of each element are as follows. In the following description, the symbol "%" for contents means "mass %."

C: 0.05 to 0.25%

C (carbon) is an element necessary to ensure strength. If the content of C is less than 0.05%, a tensile strength of 780 MPa or more cannot be provided. On the other hand, if the content of C is more than 0.25%, martensite is excessively hardened, resulting in deterioration in toughness and loss of weldability. The content of C is therefore set to 0.05 to 0.25%. The content of C is preferably 0.07% or more or 0.09% or more, and is preferably 0.22% or less, 0.20% or less, or 0.18% or less, more preferably 0.15% or less.

Si: 0.2 to 2.0%

Si (silicon) is an element that contributes to enhancement of strength. Si forms $Fe_2SiO_4$, which has a low melting point, in surfaces of the steel sheet, thus having an effect of acting on a texture in a near-surface portion that develops in hot rolling in such a manner as to make the texture have a low bending anisotropy. On the other hand, if Si is contained excessively, a surface oxidation problem arises in hot rolling. The content of Si is thus set to 0.2 to 2.0%. The content of Si is preferably 0.3% or more or 0.5% or more, and is preferably 1.8% or less, 1.5% or less, or 1.3% or less.

Mn: 1.2 to 3.0%

Mn (manganese) has an effect of stabilizing austenite to facilitate formation of low-temperature transformation phases, contributing to ensuring strength. On the other hand, if Mn is contained excessively, a volume ratio of ferrite is decreased, resulting in deterioration in elongation. The content of Mn is thus set to 1.2 to 3.0%. The content of Mn is preferably 1.5% or more or 1.7% or more, and is preferably 2.8% or less, 2.5% or less, or 2.2% or less.

P: 0.030% or Less

P (phosphorus) has an effect of increasing strength. Therefore, P may be contained positively. However, if P is contained excessively, embrittlement due to grain-boundary segregation occurs. Thus, when contained, the content of P is set to 0.030% or less. The content of P is preferably 0.025% or less, more preferably 0.020% or less. It is not necessary to put a lower limit to the content of P. The content of P may be 0%. However, an excessive reduction of the content of P leads to an increase in a production cost. Thus, the content of P is preferably 0.001% or more. Note that P is usually mixed in at an impurity level of about 0.010% in a steel making stage.

S: 0.050% or Less

S (sulfur) forms sulfide-based inclusions, thus decreasing elongation. Thus, the content of S is kept to 0.050% or less. In order to ensure an excellent elongation, the content of S is preferably 0.0080% or less, more preferably 0.0030% or less. It is not necessary to put a lower limit to the content of S. The content of S may be 0%. However, an excessive reduction of the content of S leads to an increase in a production cost. Thus, the content of S is preferably 0.0005% or more or 0.0010% or more.

Al: 0.01 to 0.55%

Al (aluminum) is an element used for deoxidation. However, if Al is excessively contained, it becomes difficult to perform continuous casting stably. Thus, the content of Al is set to 0.01 to 0.55%. A high content of Al destabilizes austenite at high temperatures, making it necessary to raise a finish rolling temperature excessively in hot rolling. Thus, the content of Al is preferably set to 0.50% or less, 0.45% or less, 0.40% or less, 0.30% or less, or 0.20% or less. Note that, in the present invention, the content of Al means the content of acid-soluble Al (sol.Al). In order to produce retained austenite to enhance elongation, it is preferable that the total content of Al and Si described above be set to 1.0% or more.

N: 0.0100% or Less

N (nitrogen) is an element that decreases elongation. Thus, the content of N is set to 0.0100% or less. The content of N is preferably 0.0060% or less or 0.0040% or less. It is not necessary to provide a lower limit to the content of N. The content of N may be at an impurity level. N is usually mixed in at about 0.0020% in a steel making stage.

Ti: 0.010 to 0.250%

Ti (titanium) precipitates in the form of its carbide in a micro-structure of a hot-rolled sheet, contributing to enhancement of strength. Further, Ti is an element that prevents austenitic grains from coarsening, thus contributing to enhancement of toughness. In particular, in the present invention, finish rolling at a high temperature is essential to control a texture in a near-surface portion, as will be described later. In order also to prevent the grains from coarsening in the finish rolling, it is necessary to exploit the effects. In addition, Ti enhances a strength of ferrite to reduce a difference in hardness from a hard second phase, thus contributing to enhancement of bendability. On the other hand, if Ti is contained excessively, Ti forms its coarse carbide or nitride in furnace heating before hot rolling, decreasing elongation. The content of Ti is thus set to 0.010 to 0.250%. The content of Ti is preferably 0.030% or more or 0.050% or more, and is preferably 0.200% or less or 0.150% or less.

The steel sheet according to the present invention may be made to contain, in addition to the elements described above, one or more elements selected from Cr, Ni, Cu, Nb, V, Zr, Mo, W, Sn, Sb, Te, Ca, Mg, REM, and B. Note that it is not necessary to put lower limits to contents of all the elements. The contents of the elements may be 0%.

Cr: 0.50% or less

Ni: 0.50% or less

Cu: 0.50% or less

Cr (chromium), Ni (nickel), and Cu (copper) each have an action of increasing hardenability to produce martensite and/or bainite effectively. Thus, Cr, Ni, and Cu may be each contained as necessary. However, if Cr, Ni, and Cu are each contained excessively, production of ferrite is prevented. Thus, the contents of these elements are each set to 0.50% or less. The contents of the elements are each preferably 0.45% or less, 0.40% or less, or 0.35% or less. To provide the effect, it is preferable that 0.10% or more, 0.15% or more, or 0.20% or more of one or more elements selected from the elements described above be contained.

Nb: 0.040% or Less

Nb (niobium) precipitates in the form of its carbide or nitride, thus having an effect of preventing recrystallization and coarsening of austenite to prevent deterioration in a toughness of a weld zone. Accordingly, Nb may be contained as necessary. However, if Nb is contained excessively, a recrystallization temperature of austenite is raised excessively, making it difficult to control a texture in a near-surface portion. Thus, the content of Nb is set to 0.040% or less. The content of Nb is preferably 0.035% or less or 0.030% or less. To provide the effect, the content of Nb is preferably set to 0.010% or more, 0.015% or more, or 0.020% or more.

V: 0.15% or less

Zr: 0.15% or less

Mo: 0.15% or less

W: 0.15% or less

V (vanadium), Zr (zirconium), Mo (molybdenum), and W (tungsten) are elements each of which precipitates in the form of its carbide in a micro-structure of a hot-rolled sheet, contributing to enhancement of strength. In addition, V, Zr, Mo, and W each enhance a strength of ferrite to reduce a difference in hardness from a hard second phase, thus contributing to enhancement of bendability. Thus, V, Zr, Mo, and W may be each contained as necessary. However, if contained excessively, V, Zr, Mo, and W each form its coarse carbide, not only impairing elongation but also resulting in an increase in an alloy cost. The contents of these elements are each set to 0.15% or less, preferably 0.12% or less. To provide the effects, it is preferable that 0.01% or more, 0.03% or more, or 0.05% or more of one or more elements selected from the elements described above be contained.

One or More Elements Selected from Sn, Sb, and Te: 0.100% or Less in Total

Sn (tin), Sb (antimony), and Te (tellurium) each segregate in surfaces of steel to prevent particularly formation of an internal oxidized layer in a high-Si alloyed steel, contributing to enhancement of pickling properties. Thus, Sn, Sb, and Te may be each contained as necessary. However, if contained excessively, Sn, Sb, and Te segregate at grain boundaries to decrease toughness. Thus, the content of these elements in total is set to 0.100% or less, preferably 0.050% or less. To provide the effect, it is preferable that these elements be contained at a content of 0.005% or more or 0.010% or more in total.

One or More Elements Selected from Ca, Mg, and REM: 0.0050% or Less in Total

Ca (calcium), Mg (magnesium), and REM (rare-earth metal) refine oxides and nitrides that precipitate during solidification, thus having an action of keeping soundness of a cast piece. Thus, Ca, Mg, and REM may be each contained as necessary. However, these elements are all expensive. Thus, the content of these elements is set to 0.0050% or less in total, preferably 0.0030% or less. To provide the effect, it is preferable that these elements be contained at a content of 0.0005% or more or 0.0010% or more in total.

Here, REM refers to 17 elements including Sc (scandium), Y (yttrium), and lanthanoids. The content of REM means a total content of these elements. Industrially, REM is added in the form of misch metal.

B: 0.0050% or Less

B (boron) segregates at grain boundaries to strengthen the grain boundaries, thus contributing to enhancement of a toughness of the steel sheet. Thus, B may be contained as necessary. On the other hand, if B is contained excessively, cracking occurs on surfaces of the resultant steel material in casting, impairing productivity. Thus, an upper limit of the content of B is set to 0.0050% or less. The content of B is preferably 0.0040% or less, more preferably 0.0020% or less. To provide the effect, it is preferable that 0.0005% or more, 0.0007% or more, or 0.0010% or more of B be contained.

In the chemical composition of the steel sheet according to the present invention, the balance includes Fe and impurities. Note that the "impurities" mean components that are mixed in steel in producing the steel industrially from raw materials such as ores and scraps and due to various factors in the producing process, and are allowed to be mixed in the steel within their respective ranges within which the impurities have no adverse effect on the present invention.

(B) Texture in Near-Surface Portion of Steel Sheet

Random intensity ratio: 8.0 or less

Minimum angle formed between a maximum strength orientation in a {110} pole figure and a normal direction of a rolled surface of the steel sheet: 100 or less. As described above, controlling a texture in a near-surface portion of a steel sheet can prevent the formation of a shear band, which serves as a precursor phenomenon of cracking occurring on a bending ridge on an outer side. For the controlling, specifically, a random intensity ratio of a texture in a near-surface portion of the steel sheet is brought to 8.0 or less, and at the same time, a minimum angle formed between a maximum strength orientation in a {110} pole figure and a normal direction of a rolled surface of the steel sheet is brought to 10° or less. Note that the near-surface portion of the steel sheet means a region extending by 200 m from a surface of the steel sheet in a depth direction in the present invention.

The random intensity ratio of the texture in the near-surface portion of the steel sheet is preferably 7.0 or less, more preferably 5.0 or less. The lower the random intensity ratio, the better it is. It is therefore not necessary to put a lower limit on the random intensity ratio, but if the random intensity ratio is 3.0 or less, the effect is saturated. In addition, a theoretical lower limit of the random intensity ratio is 1.0. At the same time, the minimum angle formed between the maximum strength orientation in the {110} pole figure and the normal direction of the rolled surface of the steel sheet is preferably 7.5° or less.

The random intensity ratio of the texture in the near-surface portion of the steel sheet and the minimum angle formed between the maximum strength orientation in the {110} pole figure and the normal direction of the rolled surface of the steel sheet are measured by the following procedures. First, a section of the steel sheet that is parallel to the rolling direction and the sheet thickness direction is exposed, and crystal orientations are measured by the electron backscatter diffraction (SEM-EBSD) method at 0.5 m intervals in a region that extends by 600 m in the rolling direction and 200 m in the sheet thickness direction from a surface of the steel sheet.

Next, from the resultant crystal orientation group, an ODF is determined by performing a spherical harmonics expansion with a half-value width of 5 degrees with a sample symmetry being assumed to be in a monoclinic system, the mirror plane of which is a rolling-thickness direction section, random intensity ratios of crystal orientations are calculated at 5-degree intervals in an Euler space, and the largest random intensity ratio of the random intensity ratios is determined.

In addition, from the resultant crystal orientation group, a {110} pole figure is calculated by performing a spherical harmonics expansion with a half-value width of 5 degrees with a sample symmetry being assumed to be in a monoclinic system, the mirror plane of which is a rolling-thickness direction section, and an angle formed by a maximum strength orientation in the {110} pole figure and a normal direction of the rolled surface, that is, a center point of the {110} pole figure is determined.

Here, when the near-surface texture is analyzed, setting of a sample symmetry is highly important. When the analysis is conducted at a sheet-thickness center, analysis of the texture is generally conducted with its sample symmetry being assumed to be in a rhombic system. However, such an analyzing method cannot evaluate the texture in the near-surface portion accurately.

Results of a preparatory experiment conducted by the present inventors will be described below. Test No. 24 in Example described later is a comparative example produced by a method that was out of appropriate conditions. As a result of calculation performed on a steel sheet in Test No. 24 with its sample symmetry being assumed to be in a rhombic system, its random intensity ratio was 3.7, and its angle formed with a center point of its {110} pole figure was 10°. Therefore, specifications according to the present invention were satisfied. In contrast, in the case where the calculation was performed with the sample symmetry being assumed to be in a monoclinic system, the random intensity ratio was 8.2, and the angle formed with a center point of the {110} pole figure was 10°. Consequently, they were out of the specifications according to the present invention. The results also show that the texture in the near-surface portion cannot be evaluated correctly in some cases unless the method according to the present invention is used.

(C) Thickness

There are no specific restrictions on the thickness of the steel sheet according to the present invention. However, in the case where the steel sheet is used as a starting material of an undercarriage component of a private automobile, a truck, or the like, the thickness of the steel sheet is preferably 1.0 to 5.0 mm, more preferably 1.2 to 3.2 mm.

(D) Metal Micro-Structure in Sheet-Thickness Center Portion

In the present invention, bendability can be improved by controlling the texture in the near-surface portion as described above. Accordingly, there are no specific restrictions on a metal micro-structure in a sheet-thickness center portion of the steel sheet.

However, to provide a favorable elongation while ensuring a high strength, it is preferable that a metal micro-structure of the steel sheet at its sheet-thickness center portion contain, in area fraction, 5 to 40% of ferrite, 60 to 95% of martensite and bainite in total, and that the balance be less than 5%. Here, in the present invention, a product of a tensile strength and an elongation after fracture is preferably 10000 MPa % or more from the viewpoint of combining strength and elongation. The product of a tensile strength and an elongation after fracture is more preferably 12000 MPa % or more, further preferably 14000 MPa % or more.

Ferrite is soft, thus contributing to enhancement of elongation. For that reason, in the case where providing an excellent elongation is intended while a tensile strength of 780 MPa or more is ensured, an area fraction of ferrite is preferably set to 5 to 40%. The area fraction of ferrite is more preferably 10% or more and is more preferably 30% or less, further preferably 20% or less.

Martensite and bainite enhance a strength of the steel sheet. In addition, when appropriately intermixed with ferrite, martensite and bainite contribute to enhancement of elongation. Thus, a total area fraction of martensite and bainite is preferably set to 60 to 95%. To provide the effects more reliably, an area fraction of martensite is preferably set to 15% or more or 20% or more. On the other hand, from the viewpoint of ensuring toughness in addition to the effects, the area fraction of martensite is preferably set to 80% or less, more preferably set to 70% or less or 60% or less. Note that, in the present invention, the martensite includes fresh martensite as well as tempered martensite.

An area fraction of the balance, other than the ferrite, martensite, and bainite, is preferably less than 5%. As the balance of the metal micro-structure, specifically, pearlite, cementite, and retained austenite can be mixed in. A total area fraction of pearlite and cementite is preferably set to less than 5% from the viewpoint of ensuring uniform elongation. In addition, although retained austenite is a structure that enhances uniform elongation, an area fraction of retained austenite is preferably set to less than 5% from the viewpoint of ensuring hole expandability.

(E) Method for Producing Steel Sheet

An example of a method for producing the steel sheet according to the present invention will be described below in detail. The steel sheet according to the present invention can be provided by, for example, a producing method including the following steps.

<Slab Producing Step>

It suffices that a conventional method is used to produce a cast piece to be subjected to hot rolling. That is, a slab obtained by continuous casting, or casting and blooming, a steel sheet obtained by strip casting, or the like can be used.

<Hot Rolling Step>

The cast piece is subjected to the hot rolling. To control the texture in the near-surface portion of the steel sheet, it is important to adjust hot rolling conditions. Conditions for the hot rolling step will be described below in detail.

Heating Temperature: 1050 to 1300° C.

In order to dissolve Ti in the steel, a heating temperature before the hot rolling is set to 1050° C. or more. On the other hand, the heating temperature is preferably set to 1300° C. or less in view of a durability of a heating furnace.

Effective Rolling Strain: 0.20 to 0.80

By adjusting a rolling reduction of a final rolling or in rolling reductions of a final rolling and a rolling immediately prior to the final rolling to bring an effective rolling strain defined below within a range of 0.20 to 0.80, a texture of austenite is prevented from excessively developing, so that the texture in the near-surface portion after γ-α transformation can be controlled. The effective rolling strain will be described below.

Let F0 denote a rolling stress by the rolling immediately prior to the final rolling reduction, and let F1 denote a rolling stress by the final rolling. When a value of (F1−F0)/F0 is less than 0.18, a rolling strain by the final rolling is taken as the effective rolling strain, and when the value of (F1−F0)/F0 is 0.18 or more, a sum of rolling strains by the final rolling and the rolling immediately prior to the final rolling is taken as the effective rolling strain.

Here, the rolling stresses are each a value of a rolling load divided by a product of a contact projection length Ld between a rolling roll and the steel sheet and a sheet width of the steel sheet. The contact projection length Ld is determined by Formula (1) shown below. The rolling strains are each an absolute value of a true strain. That is, an effective rolling strain εeff is determined by Formula (2) and Formula (3) shown below.

$$Ld=\sqrt{(Rd(hin-hout))} \quad (i)$$

Rd: Radius of roll hin: Sheet thickness at entrance side hout: Sheet thickness at delivery side When (F1−F0)/F0≥0.18

$$\varepsilon eff=|\ln(t0/tini)+\ln(t1/t0)| \quad (2)$$

When (F1−F0)/F0<0.18

$$\varepsilon eff=|\ln(t1/t0)| \quad (3)$$

tini: Sheet thickness before the rolling immediately prior to the final rolling t0: Sheet thickness after the rolling immediately prior to the final rolling t1: Sheet thickness after the final rolling Finish rolling temperature: $T_{SC}$° C. or more and 920° C. or more to 1080° C. or less By setting the finish rolling temperature to $T_{SC}$° C., which is given by Formula (i) shown below, or more and 920° C. or more, the texture in the near-surface portion of the steel sheet can be controlled, which exerts an effect particularly on reduction of the minimum angle formed between the maximum strength orientation in the {110} pole figure and the normal direction of the rolled surface of the steel sheet. The reason for this is not exactly clear, but it is probable that, at temperatures $T_{SC}$° C. or more and 920° C. or more, $Fe_2SiO_4$ formed in surfaces of the steel sheet is softened, which decreases an amount of shearing deformation added to surfaces of the steel sheet. Here, "finish rolling temperature" means a temperature of the steel sheet after the final rolling.

$$T_{SC}=965+100\times((5\times P+0.5\times Al)/Si)^2-170\times((5\times P+0.5\times Al)/Si) \quad (i)$$

where symbols of elements in the formula each indicate a content of the element (mass %).

On the other hand, if the finish rolling temperature is more than 1080° C., there is the risk that a surface quality deterioration due to a scale defect may occur. The finish rolling temperature of the hot rolling is therefore set to 1080° C. or less.

Time Between Final Rolling and Rolling Immediately Prior to Final Rolling: 0.50 s or More If a time between the final rolling and the rolling immediately prior to the final rolling is less than 0.50 s, a difference in temperature between a rolling entrance side of the final rolling and a rolling entrance side of the rolling immediately prior to the final rolling is highly likely to become less than 15° C. In this case, an accumulation of strain at the time of the rolling immediately prior to the final rolling is likely to be kept at the time of the final rolling. As a result, the amount of shearing deformation added to the surfaces of the steel sheet is increased, and the minimum angle formed between the maximum strength orientation in the {110} pole figure and the normal direction of the rolled surface of the steel sheet is increased. In addition, there is a risk that the time between the final rolling and the rolling immediately prior to the final rolling that is less than 0.50 s may in some cases lead to an increase of a rolling stress in the final rolling, causing a trouble in the rolling. For this reason, the time between the final rolling and the rolling immediately prior to the final rolling is set to 0.50 s or more so that a rolling entrance side temperature in the final rolling is lower than a rolling entrance side temperature in the rolling immediately prior to the final rolling by 15° C. or more. The time between the final rolling and the rolling immediately prior to the final rolling is preferably set to 0.75 s or more. On the other hand, a time between the final rolling and the rolling immediately prior to the final rolling that is more than 3.0 s leads to a significant decrease in line speed. As a result, there is a risk that the finish rolling temperature cannot be maintained at $T_{SC}$° C. or more and 920° C. or more, and the near-surface texture cannot be controlled appropriately. Therefore, the time is preferably set to 3.0 s or less, more preferably 2.0 s or less.

Time Until Start of Water Cooling after Finish Rolling: 0.50 s or More

By setting a time until start of water cooling after the finish rolling to 0.50 s or more, the texture in the near-surface portion after the γ-α transformation can be controlled, which exerts an effect particularly on reduction of the random intensity ratio. If the time until the start of water cooling is less than 0.50 s, recrystallization of austenite is prevented. As a result, a texture of austenite in the near-surface portion that excessively develops by rolling is transferred to a phases after the transformation, decreasing bendability. Therefore, the time until the start of the water cooling after the finish rolling is set to 0.50 s or more, preferably 0.80 s or more. On the other hand, if the time until the start of water cooling is more than 3.0 s, growth of austenite grains becomes prominent, which reduces an amount of ferrite produced, and there is a risk that elongation may be lost. Therefore, the time until the start of water cooling after the finish rolling is preferably set to 3.0 s or less, more preferably 1.5 s or less.

First Cooling Rate: 15° C./s or More

There are no specific restrictions on a cooling rate after the finish rolling. However, a first cooling rate is preferably set to 15° C./s or more, more preferably set to 30° C./s or more. With this setting, precipitation of pearlite and coarsening of precipitates can be prevented, and strength can be enhanced. On the other hand, the first cooling rate is preferably set to less than 60° C./s from the viewpoint of preventing excessive production of martensite and keeping ferrite. The first cooling rate means an average cooling rate obtained by dividing a difference between the finish rolling temperature and a temperature that is 500° C. or a first cooling stop temperature described later, whichever is higher, by a time taken to cool the steel sheet to the temperature.

First Cooling Stop Temperature: 600 to 680° C.

After the finish rolling, the steel sheet may be cooled as it is to a coiling temperature described later, but the cooling may be stopped in the middle of it at a temperature within a range of 600 to 680° C. for producing ferrite in a metal micro-structure in an inner portion of the steel sheet. To provide the effect more reliably, the first cooling stop temperature is preferably set to 630° C. or more. To provide the effect sufficiently, the steel sheet is preferably held at a temperature within a range of the first cooling stop temperature for 2 to 15 s. By setting a holding time to 2 to 15 s, a moderate amount of ferrite can be formed. The holding time is more preferably set to 5 to 10 s.

Second Cooling Rate: 10° C./s or More

In the case where the cooling is stopped at the first cooling temperature, second cooling is subsequently performed. There are no specific restrictions on a second cooling rate. However, the second cooling rate is preferably set to 10° C./s or more. With this setting, a structural fraction of pearlite and retained austenite can be reduced to less than 5%. On the other hand, the second cooling rate is preferably set to 50° C./s or less from the viewpoint of preventing flatness defects of the steel sheet to enhance productivity. The second cooling rate means an average cooling rate obtained by dividing a difference between the first cooling stop temperature and the coiling temperature by a time taken to cool the steel sheet to the coiling temperature.

<Coiling Step>

Coiling temperature: 100 to 500° C.

There are no specific restrictions on the coiling temperature, either. However, the steel sheet is preferably coiled at a temperature of 500° C. or less from the viewpoint of producing bainite and/or martensite to ensure strength. On the other hand, if the coiling temperature is excessively low, there is a risk that flatness defects may occur on the steel sheet, impairing productivity. Thus, the coiling temperature is preferably set to 100 to 500° C., more preferably set to 150 to 450° C.

The present invention will be described below more specifically with examples, but the present invention is not limited to these examples.

EXAMPLES

Steels having chemical compositions shown in Table 1 were melted in a vacuum furnace, reheated to 1050° C. or more, and then subjected to hot rolling with a small hot rolling mill for test, under conditions shown in Table 2. After the hot rolling, the coiling step with an actual machine was simulated in such a manner that the hot-rolled steels were subjected to water cooling to temperatures equivalent to the coiling temperature under cooling conditions shown in Table 2 with a water cooling apparatus placed immediately subsequent to the roll stands, subsequently charged into a heating furnace that was set to the temperatures equivalent to the coiling temperature, held for 30 minutes, and then subjected to slow cooling to a room temperature at 20° C./h.

[Table 1]

TABLE 1

| | Chemical composition (mass %, balance: Fe and impurity) | | | | | | | | | | | | | | | | | |
|---|---|---|---|---|---|---|---|---|---|---|---|---|---|---|---|---|---|---|
| Steel | C | Si | Mn | P | S | Al | N | Ti | Cr | Ni | Cu | Nb | V | Zr | Mo | W | B | Others |
| A | 0.07 | 1.0 | 1.8 | 0.012 | 0.0010 | 0.30 | 0.0032 | 0.110 | | | | | | | | | | |
| B | 0.08 | 1.3 | 2.4 | 0.015 | 0.0010 | 0.03 | 0.0028 | 0.130 | | | | 0.030 | | | | | 0.0010 | |
| C | 0.12 | 0.4 | 1.3 | 0.015 | 0.0010 | 0.03 | 0.0024 | 0.080 | | | | | 0.10 | | | | | Ca + Mg: 0.0010 |
| D | 0.18 | 0.4 | 1.5 | 0.010 | 0.0010 | 0.05 | 0.0028 | 0.080 | | | | | 0.12 | | | | | |
| E | 0.12 | 0.8 | 1.3 | 0.010 | 0.0010 | 0.10 | 0.0032 | 0.080 | | | | 0.027 | 0.15 | | | | | Ca + REM: 0.0010 |
| F | 0.05 | 1.0 | 1.5 | 0.018 | 0.0020 | 0.03 | 0.0025 | 0.030 | | | | | | 0.10 | | | | Sb: 0.020 |
| G | 0.12 | 0.5 | 2.0 | 0.012 | 0.0030 | 0.03 | 0.0030 | 0.050 | | | | 0.030 | | | | 0.10 | | |
| H | 0.11 | 0.8 | 1.2 | 0.020 | 0.0012 | 0.03 | 0.0030 | 0.080 | 0.15 | | | | | | 0.10 | | | |
| I | 0.10 | 0.6 | 1.7 | 0.008 | 0.0010 | 0.03 | 0.0033 | 0.120 | | 0.31 | 0.30 | | | | | | | |
| J | 0.18 | 1.8 | 2.0 | 0.012 | 0.0010 | 0.03 | 0.0038 | 0.045 | | | | | | | | | 0.0012 | |
| K | 0.13 | 1.0 | 1.2 | 0.013 | 0.0011 | 0.03 | 0.0030 | 0.090 | | | | | 0.12 | | | | | Mg: 0.0020, Sn: 0.03 |
| L | 0.05 | 0.4 | 0.2 | 0.010 | 0.0010 | 0.03 | 0.0030 | 0.100 | | | | 0.010 | | | | | | |
| M | 0.02 | 0.2 | 1.5 | 0.010 | 0.0010 | 0.03 | 0.0028 | | 0.31 | | | | | | 0.60 | | 0.0010 | |
| N | 0.18 | 0.4 | 2.0 | 0.010 | 0,0010 | 0.03 | 0.0030 | — | | | | | | | | | | |
| O | 0.15 | 1.2 | 4.2 | 0.020 | 0.0010 | 0.03 | 0.0028 | 0.020 | | | | 0.010 | | | | | | |
| P | 0.07 | 1.1 | 1.8 | 0.016 | 0.0012 | 0.03 | 0.0032 | 0.150 | | | | 0.050 | | | | | | |

TABLE 2

| Test No. | Steel | Heating temperature (° C.) | ST0 (° C.) | ST1 (° C.) | FT (° C.) | $T_{SC}$ (° C.) | tini (min) | t0 (min) | t1 (min) | Inter-pass time (s) | Time from rolling to water cooling start (s) |
|---|---|---|---|---|---|---|---|---|---|---|---|
| 1 | A | 1290 | 1030 | 992 | 963 | 934 | 7.8 | 5.0 | 3.2 | 1.0 | 1.0 |
| 2 | B | 1250 | 1015 | 990 | 965 | 954 | 7.8 | 5.0 | 3.2 | 1.0 | 1.0 |
| 3 | B | 1280 | 1015 | 999 | 965 | 954 | 9.5 | 5.5 | 3.2 | 0.0 | 0.5 |
| 4 | B | 1280 | 1060 | 1026 | 994 | 954 | 8.0 | 4.8 | 3.2 | 1.0 | 3.0 |
| 5 | B | 1280 | 1025 | 984 | 959 | 954 | 6.6 | 4.5 | 3.2 | 1.0 | 2.0 |
| 6 | B | 1280 | 1000 | 966 | 955 | 954 | 7.6 | 6.6 | 3.6 | 0.5 | 1.0 |
| 7 | C | 1280 | 1045 | 977 | 948 | 932 | 7.8 | 5.0 | 3.2 | 2.0 | 1.0 |
| 8 | D | 1280 | 1050 | 980 | 953 | 937 | 8.6 | 5.4 | 3.6 | 2.0 | 1.0 |
| 9 | E | 1250 | 1025 | 987 | 958 | 945 | 7.8 | 5.0 | 3.2 | 1.0 | 1.0 |
| 10 | F | 1180 | 1030 | 992 | 963 | 948 | 7.8 | 5.0 | 3.2 | 1.0 | 1.0 |
| 11 | G | 1280 | 1050 | 982 | 953 | 942 | 7.8 | 5.0 | 3.2 | 2.0 | 1.0 |
| 12 | H | 1250 | 1060 | 1022 | 993 | 943 | 7.8 | 5.0 | 3.2 | 1.0 | 1.0 |
| 13 | H | 1250 | 1060 | 1031 | 999 | 943 | 7.8 | 5.0 | 3.2 | 1.0 | 1.0 |
| 14 | I | 1200 | 1040 | 1002 | 973 | 950 | 7.8 | 5.0 | 3.2 | 1.0 | 1.0 |
| 15 | J | 1250 | 1040 | 998 | 973 | 958 | 6.2 | 4.3 | 3.0 | 1.0 | 1.0 |
| 16 | J | 1250 | 1020 | 1003 | 971 | 958 | 8.4 | 5.0 | 3.0 | 0.6 | 0.5 |
| 17 | K | 1250 | 1050 | 1018 | 990 | 951 | 7.8 | 5.0 | 3.2 | 1.0 | 1.0 |
| 18 | A | 1280 | 1000 | 970 | 940 | 934 | 7.6 | 6.6 | 3.6 | 0.8 | 1.0 |
| 19 | C | 1280 | 1000 | 965 | 938 | 932 | 7.6 | 6.6 | 3.6 | 0.6 | 1.0 |
| 20 | B | 1280 | 1020 | 985 | 960 | 954 | 6.6 | 4.5 | 3.2 | 1.0 | 2.0 |
| 21 | B | 1280 | 910 | 891 | 866 | 954 | 6.6 | 4.5 | 2.9 | 0.5 | 1.0 |
| 22 | B | 1280 | 1025 | 975 | 964 | 954 | 7.9 | 5.0 | 3.2 | 0.5 | 0.1 |
| 23 | G | 1280 | 1050 | 983 | 953 | 942 | 15.0 | 9.4 | 5.0 | 1.0 | 0.5 |
| 24 | J | 1250 | 1030 | 988 | 963 | 958 | 5.2 | 4.3 | 3.0 | 0.5 | 0.03 |
| 25 | J | 1250 | 950 | 933 | 901 | 958 | 8.4 | 5.0 | 3.0 | 0.6 | 0.5 |
| 26 | J | 1250 | 1080 | 953 | 942 | 958 | 6.0 | 4.3 | 3.2 | 4.0 | 1.0 |
| 27 | B | 1280 | 1000 | 970 | 963 | 954 | 6.6 | 4.5 | 3.2 | 0.4 | 2.0 |
| 28 | L | 1250 | 1040 | 969 | 944 | 940 | 6.6 | 4.2 | 2.9 | 2.0 | 0.5 |

TABLE 2-continued

| | | | | | | | | | | | |
|---|---|---|---|---|---|---|---|---|---|---|---|
| 29 | M | 1250 | 1010 | 969 | 944 | 920 | 6.0 | 4.5 | 2.9 | 1.0 | 0.5 |
| 30 | N | 1250 | 1000 | 979 | 950 | 940 | 7.8 | 5.0 | 2.6 | 0.6 | 0.5 |
| 31 | O | 1250 | 1020 | 982 | 953 | 950 | 7.8 | 5.0 | 2.6 | 1.0 | 0.5 |
| 32 | P | 1280 | 1010 | 985 | 960 | 951 | 7.6 | 6.6 | 3.6 | 0.5 | 0.5 |

| Test No. | Steel | F0 (MPa) | F1 (MPa) | (F1-F0)/F0 | Effective rolling strain | First cooling rate (° C./s) | First cooling stop temperature (° C.) | Holding time (s) | Second cooling rate (° C./s) | Coding temperature (° C.) |
|---|---|---|---|---|---|---|---|---|---|---|
| 1 | A | 203 | 224 | 0.10 | 0.45 | 40 | 650 | 4 | 40 | 150 |
| 2 | B | 227 | 254 | 0.12 | 0.45 | 15 | 500 | — | — | 500 |
| 3 | B | 235 | 252 | 0.07 | 0.54 | 50 | 600 | 5 | 30 | 350 |
| 4 | B | 214 | 223 | 0.04 | 0.41 | 20 | 600 | 5 | 10 | 350 |
| 5 | B | 217 | 250 | 0.15 | 0.34 | 20 | 600 | 5 | 10 | 350 |
| 6 | B | 154 | 273 | 0.77 | 0.75 | 40 | 610 | 3 | 40 | 150 |
| 7 | C | 195 | 229 | 0.17 | 0.45 | 40 | 650 | 5 | 40 | 480 |
| 8 | D | 198 | 228 | 0.15 | 0.41 | 40 | 650 | 5 | 30 | 420 |
| 9 | E | 215 | 243 | 0.13 | 0.45 | 40 | 650 | 10 | 40 | 350 |
| 10 | F | 190 | 210 | 0.11 | 0.45 | 40 | 630 | 3 | 10 | 360 |
| 11 | G | 180 | 210 | 0.17 | 0.45 | 40 | 650 | 10 | 40 | 180 |
| 12 | H | 187 | 206 | 0.10 | 0.45 | 60 | 600 | 5 | 40 | 150 |
| 13 | H | 184 | 203 | 0.10 | 0.45 | 50 | 640 | 5 | 40 | 180 |
| 14 | I | 193 | 213 | 0.10 | 0.45 | 40 | 650 | 3 | 15 | 400 |
| 15 | J | 197 | 217 | 0.10 | 0.36 | 40 | 650 | 5 | 40 | 350 |
| 16 | J | 215 | 228 | 0.06 | 0.51 | 40 | 650 | 5 | 40 | 350 |
| 17 | K | 191 | 211 | 0.10 | 0.45 | 50 | 630 | 5 | 40 | 200 |
| 18 | A | 151 | 246 | 0.63 | 0.75 | 40 | 650 | 4 | 40 | 150 |
| 19 | C | 150 | 242 | 0.61 | 0.75 | 40 | 670 | 10 | 40 | 480 |
| 20 | B | 215 | 249 | 0.15 | 0.34 | 70 | 100 | — | — | 100 |
| 21 | B | 276 | 327 | 0.18 | 0.82 | 40 | 600 | 5 | 10 | 350 |
| 22 | B | 225 | 266 | 0.18 | 0.90 | 40 | 600 | 5 | 10 | 350 |
| 23 | G | 175 | 212 | 0.21 | 1.10 | 40 | 650 | 10 | 10 | 450 |
| 24 | J | 165 | 231 | 0.40 | 0.55 | 40 | 650 | 5 | 40 | 350 |
| 25 | J | 250 | 265 | 0.06 | 0.51 | 80 | 650 | 5 | 40 | 350 |
| 26 | J | 180 | 226 | 0.26 | 0.63 | 40 | 660 | 5 | 40 | 350 |
| 27 | B | 231 | 255 | 0.15 | 0.34 | 20 | 600 | 5 | 10 | 350 |
| 28 | L | 187 | 220 | 0.18 | 0.37 | 60 | 650 | 5 | 40 | 500 |
| 29 | M | 194 | 220 | 0.13 | 0.44 | 40 | 500 | — | — | 500 |
| 30 | N | 194 | 215 | 0.11 | 0.65 | 40 | 650 | 5 | 40 | 500 |
| 31 | O | 214 | 250 | 0.17 | 0.65 | 20 | 650 | 3 | 5 | 500 |
| 32 | P | 151 | 265 | 0.75 | 0.76 | 60 | 550 | 3 | 40 | 450 |

In Table 2, ST0 means the entrance side temperature (° C.) in the rolling immediately prior to the final rolling, ST1 means the entrance side temperature (° C.) in the final rolling, and FT means the finish rolling temperature (° C.). In addition, "Inter-pass time" is the time between the final rolling and the rolling immediately prior to the final rolling, and "Time from rolling to water cooling start" means the time until the start of water cooling after the finish rolling.

In a sheet-thickness center portion of each of the resultant steel sheets, a section that was parallel to the rolling direction and the thickness direction was cut, subjected to mirror polish, and then subjected to Nital etching, by which its steel micro-structure was exposed, and the metal micro-structure was observed with a SEM. Further, a section of the steel sheet that was parallel to the rolling direction and the sheet thickness direction was exposed, and crystal orientations were measured by the SEM-EBSD at 0.5 m intervals in a region that extended by 600 m in the rolling direction and 200 m in the sheet thickness direction from a surface of the steel sheet.

Then, from the resultant crystal orientation group, an ODF was determined by performing a spherical harmonics expansion with a half-value width of 5 degrees with a sample symmetry being assumed to be in a monoclinic system, random intensity ratios of crystal orientations were calculated at 5-degree intervals in an Euler space, and the largest random intensity ratio of the random intensity ratios was determined. Similarly, from the resultant crystal orientation group, a {110} pole figure was calculated by performing a spherical harmonics expansion with a half-value width of 5 degrees with a sample symmetry being assumed to be in a monoclinic system, and an angle formed by a maximum strength orientation in the {110} pole figure and a center point of the {110} pole figure was determined.

Subsequently, two tensile test specimens of No. 5 test coupon defined in JIS Z 2241:2011 were taken in such a manner that a direction perpendicular to the rolling direction of each steel sheet matches a longitudinal direction of the test specimens, and tensile strengths TS and elongations at break EL were measured in conformance with the standard, and average values of the tensile strengths TS and the elongations at break EL were determined.

In addition, of the resultant steel sheets, flexural properties of steel sheets in which TS were 780 MPa or more and TS×EL were 10000 MPa % or more were evaluated by a bending test described below. From the steel sheets, strip shaped specimens were cut and subjected to the bending test after burrs were removed carefully. The specimens were cut in such a manner that the specimens each had a length of 20 mm in a direction along a bending ridge and a length of 45 mm in a direction perpendicular to the bending ridge, and in such a manner that the bending ridge was parallel to and orthogonal to the rolling direction.

Next, V-shaped punches having a tip angle of 900 were prepared in such a manner that a ratio (Rp/t) between a sheet thickness (t) of each specimen and a punch tip radius (Rp)

was 2.0 or 1.0, and a V-bending test with a bending angle of 90° was conducted in such a manner that a longitudinal center portion of the specimen was pushed with a force of 40 kN against a die that was placed on an Instron universal testing machine and had a V-shaped groove with a groove angle of 90°. After the V-bending test, the bending ridge was subjected to SEM observation at a magnification of ×40, by which presence/absence of cracking in the vicinity of a longitudinal center portion of the bending ridge was checked. Then, a case where no cracking occurred on a bending ridge of a specimen was rated as ○, and a case where cracking occurred on a bending ridge of a specimen was rated as x.

Table 3 shows results of the above. Note that, in Table 3, a bendability in the case where a bending ridge of a test specimen is parallel to the rolling direction is called an L-direction bendability, and a bendability in the case where the bending ridge is orthogonal to the rolling direction is called a C-direction bendability.

TABLE 3

| | | Metal micro-structure | | | | | | | | | | | | | | |
|---|---|---|---|---|---|---|---|---|---|---|---|---|---|---|---|---|
| | | Near-surface portion of steel sheet | | Area fraction of metal micro-structure at sheet-thickness center portion (%) | | | | | Mechanical property | | | | | | | |
| | | Random | Minimum | | | | | | | | TS-EL | C-direction bendability | | L-direction bendability | | |
| Test No. | Steel | intensity ratio | angle* (°) | Ferrite | Perlite | Bainite | Martensite | Retained γ | TS (MPa) | EL (%) | (MPa %) | R/t = 2.0 | R/t = 1.0 | R/t = 2.0 | R/t = 1.0 | Remarks |
| 1 | A | 4.0 | 5 | 20 | 0 | 15 | 65 | 0 | 985 | 16 | 15760 | ○ | ○ | ○ | ○ | Inventive example |
| 2 | B | 4.0 | 5 | 15 | 0 | 85 | 0 | 0 | 790 | 20 | 15800 | ○ | ○ | ○ | ○ | Inventive example |
| 3 | B | 5.5 | 10 | 8 | 0 | 42 | 48 | 2 | 960 | 16 | 15362 | ○ | ○ | ○ | ○ | Inventive example |
| 4 | B | 4.0 | 2 | 7 | 0 | 38 | 53 | 2 | 980 | 15 | 14700 | ○ | ○ | ○ | ○ | Inventive example |
| 5 | B | 4.0 | 4 | 6 | 0 | 39 | 53 | 2 | 985 | 15 | 14775 | ○ | ○ | ○ | ○ | Inventive example |
| 6 | B | 4.0 | 10 | 6 | 0 | 40 | 53 | 1 | 980 | 15 | 14700 | ○ | ○ | ○ | ○ | Inventive example |
| 7 | C | 4.0 | 5 | 11 | 1 | 88 | 0 | 0 | 1142 | 14 | 15988 | ○ | ○ | ○ | ○ | Inventive example |
| 8 | D | 4.0 | 3 | 15 | 0 | 65 | 20 | 0 | 1023 | 15 | 15345 | ○ | ○ | ○ | ○ | Inventive example |
| 9 | E | 4.1 | 5 | 6 | 0 | 74 | 20 | 0 | 1066 | 15 | 15990 | ○ | ○ | ○ | ○ | Inventive example |
| 10 | F | 4.0 | 5 | 13 | 0 | 59 | 27 | 1 | 783 | 20 | 15656 | ○ | ○ | ○ | ○ | Inventive example |
| 11 | G | 4.0 | 5 | 6 | 0 | 76 | 16 | 2 | 1071 | 14 | 15000 | ○ | ○ | ○ | ○ | Inventive example |
| 12 | H | 4.0 | 4 | 3 | 0 | 15 | 82 | 0 | 1035 | 14 | 14490 | ○ | ○ | ○ | ○ | Inventive example |
| 13 | H | 3.9 | 4 | 17 | 0 | 27 | 56 | 0 | 1029 | 15 | 15435 | ○ | ○ | ○ | ○ | Inventive example |
| 14 | I | 4.0 | 4 | 8 | 0 | 92 | 0 | 0 | 1270 | 11 | 13969 | ○ | ○ | ○ | ○ | Inventive example |
| 15 | J | 4.0 | 0 | 10 | 0 | 56 | 25 | 9 | 1015 | 15 | 15230 | ○ | ○ | ○ | ○ | Inventive example |
| 16 | J | 4.0 | 8 | 8 | 0 | 56 | 27 | 9 | 1028 | 15 | 15413 | ○ | ○ | ○ | ○ | Inventive example |
| 17 | K | 3.8 | 8 | 19 | 0 | 22 | 59 | 0 | 1008 | 17 | 17136 | ○ | ○ | ○ | ○ | Inventive example |
| 18 | A | 4.0 | 10 | 15 | 0 | 15 | 70 | 0 | 1010 | 15 | 15150 | ○ | ○ | ○ | ○ | Inventive example |
| 19 | C | 4.0 | 10 | 26 | 0 | 74 | 0 | 0 | 1080 | 14 | 15120 | ○ | ○ | ○ | ○ | Inventive example |
| 20 | B | 4.0 | 4 | 0 | 0 | 0 | 100 | 0 | 1186 | 9 | 10674 | ○ | ○ | ○ | ○ | Inventive example |
| 21 | B | 11.1 | 15 | 5 | 0 | 45 | 48 | 2 | 988 | 15 | 14820 | X | — | ○ | — | Comparative example |
| 22 | B | 11.4 | 13 | 6 | 0 | 40 | 52 | 2 | 974 | 15 | 14612 | X | — | ○ | — | Comparative example |
| 23 | G | 8.1 | 11 | 15 | 0 | 85 | 0 | 0 | 1038 | 15 | 15570 | \ | — | ○ | — | Comparative example |
| 24 | J | 8.2 | 10 | 10 | 0 | 56 | 25 | 9 | 1015 | 15 | 15230 | ○ | \ | ○ | ○ | Comparative example |
| 25 | J | 8.3 | 14 | 9 | 0 | 58 | 24 | 9 | 1006 | 15 | 15089 | X | — | ○ | — | Comparative example |
| 26 | J | 7.4 | 14 | 8 | 0 | 40 | 50 | 2 | 970 | 14 | 13580 | ○ | X | ○ | ○ | Comparative example |
| 27 | B | 7.1 | 11 | 9 | 0 | 45 | 46 | 0 | 974 | 15 | 14610 | ○ | \ | ○ | ○ | Comparative example |
| 28 | L | 5.3 | 1 | 47 | 0 | 53 | 0 | 0 | 520 | 35 | 18193 | — | — | — | — | Comparative example |
| 29 | M | 4.4 | 4 | 0 | 0 | 100 | 0 | 0 | 501 | 27 | 13530 | — | — | — | — | Comparative example |
| 30 | N | 4.0 | 10 | 11 | 5 | 84 | 0 | 0 | 1018 | 12 | 12212 | ○ | X | ○ | X | Comparative example |
| 31 | O | 4.0 | 10 | 0 | 0 | 67 | 32 | 1 | 1465 | 6 | 8791 | — | — | — | — | Comparative example |
| 32 | P | 8.3 | 5 | 1 | 1 | 92 | 6 | 0 | 780 | 16 | 12480 | ○ | X | ○ | ○ | Comparative example |

*means a minimum angle formed between a maximum strength orientation in a (110) pole figure of a texture and a normal direction of a rolled surface of a steel sheet As can be seen from Table 3, in Test No. 21, its finish rolling temperature (FT) was low, and its effective rolling strain was too high. In Test No. 22, its time until the start of water cooling after the finish rolling was short, and its effective rolling strain was too high. In Test No. 23, its effective rolling strain was too high.

In Test No. 24, its time until the start of water cooling after the finish rolling was too short. In Test No. 25, its finish rolling temperature (FT) was too low. In Test No. 26, its time between the final rolling and the rolling immediately prior to the final rolling was too long. As a result, its finish rolling temperature was low. In Test No. 27, its time between the final rolling and the rolling immediately prior to the final rolling was too short. As a result, its difference in temperature between the rolling entrance side of the final rolling and the rolling entrance side of the rolling immediately prior to the final rolling was small. These examples therefore failed to control the near-surface texture, resulting in poor bendabilities.

In Test No. 28, its content of Mn was low, and in Test No. 29, its content of C was low. As a result, Test No. 28 and Test No. 29 failed to provide a sufficient strength. In Test No. 30, Ti was not contained. As a result, its difference in hardness between ferrite and the hard second phase was large, and its bendability deteriorated. In Test No. 31, its content of Mn was excessively high. As a result, its elongation deteriorated. In Test No. 32, its content of Nb was excessively high. As a result, although its production conditions were appropriate, Test No. 32 failed to control the near-surface texture, resulting in poor bendability.

In contrast to these examples, in Test Nos. 1 to 20, which satisfied all of the specifications according to the present invention, their steel sheets have high strengths and excellent elongations. In addition, the steel sheets had excellent bendabilities and had no bending anisotropy recognized.

INDUSTRIAL APPLICABILITY

According to the present invention, it is possible to provide a steel sheet that has a tensile strength of 780 MPa or more, has a low bending anisotropy, and has an excellent bendability. Accordingly, the steel sheet according to the present invention is suitably used as a starting material for an undercarriage component of a private automobile, a truck, or the like.

The invention claimed is:

1. A steel sheet having a chemical composition comprising, in mass %:

C: 0.05 to 0.25%,
Si: 0.2 to 2.0%,
Mn: 1.2 to 3.0%,
P: 0.030% or less,
S: 0.050% or less,
Al: 0.01 to 0.55%,
N: 0.0100% or less,
Ti: 0.010 to 0.250%,
Cr: 0 to 0.50%,
Ni: 0 to 0.50%,
Cu: 0 to 0.50%,
Nb: 0 to 0.040% s,
V: 0 to 0.15%,
Zr: 0 to 0.15%,
Mo: 0 to 0.15%,
W: 0 to 0.15%,
one or more elements selected from Sn, Sb, and Te at 0 to 0.100% in total,
one or more elements selected from Ca, Mg, and REM at 0 to 0.0050% in total, and
B: 0 to 0.0050%,
with the balance: Fe and impurities, wherein
a random intensity ratio of a texture in a near-surface portion of the steel sheet is 8.0 or less, and
a minimum angle formed between a maximum strength orientation in a {110} pole figure of the texture and a normal direction of a rolled surface of the steel sheet is 10° or less.

2. The steel sheet according to claim 1, wherein the chemical composition contains, in lieu of a part of the Fe, one or more elements selected from, in mass %:

Cr: 0.10 to 0.50%,
Ni: 0.10 to 0.50%, and
Cu: 0.10 to 0.50%.

3. The steel sheet according to claim 1, wherein the chemical composition contains, in lieu of a part of the Fe, one or more elements selected from, in mass %:

Nb: 0.010 to 0.040%,
V: 0.01 to 0.15%,
Zr: 0.01 to 0.15%,
Mo: 0.01 to 0.15%, and
W: 0.01 to 0.15%.

4. The steel sheet according to claim 1, wherein the chemical composition contains, in lieu of a part of the Fe, one or more elements selected from, in mass %, Sn, Sb, and Te at 0.005 to 0.100% in total.

5. The steel sheet according to claim 1, wherein the chemical composition contains, in lieu of a part of the Fe, one or more elements selected from, in mass %, Ca, Mg, and REM at 0.0005 to 0.0050% in total.

6. The steel sheet according to claim 1, wherein the chemical composition contains, in lieu of a part of the Fe, in mass %, B: 0.0005 to 0.0050%.

* * * * *